US012644208B2

(12) United States Patent
Xu et al.

(10) Patent No.: US 12,644,208 B2
(45) Date of Patent: Jun. 2, 2026

(54) AUXETIC TEXTILE STRUCTURES

(71) Applicant: HONEYWELL SAFETY PRODUCTS USA, INC., Charlotte, NC (US)

(72) Inventors: Jing Xu, Charlotte, NC (US); Xiaobai Ruan, Charlotte, NC (US); Menglong Gao, Charlotte, NC (US)

(73) Assignee: Honeywell Safety Products USA, Inc., Latham, NY (US)

( * ) Notice: Subject to any disclaimer, the term of this patent is extended or adjusted under 35 U.S.C. 154(b) by 291 days.

(21) Appl. No.: 18/455,251

(22) Filed: Aug. 24, 2023

(65) Prior Publication Data

US 2024/0084486 A1 Mar. 14, 2024

(30) Foreign Application Priority Data

Sep. 13, 2022 (CN) ..... 202211109310.8

(51) Int. Cl.

| | |
|---|---|
| ***D03D 1/00*** | (2006.01) |
| ***A41D 19/00*** | (2006.01) |
| ***A41D 19/015*** | (2006.01) |
| ***A41D 31/18*** | (2019.01) |
| ***A41D 31/24*** | (2019.01) |
| ***D03D 17/00*** | (2006.01) |

(52) U.S. Cl.

CPC ..... *D03D 1/0041* (2013.01); *A41D 19/0024* (2013.01); *A41D 19/01505* (2013.01); *A41D 31/185* (2019.02); *A41D 31/24* (2019.02); *D03D 17/00* (2013.01); *D10B 2401/061* (2013.01); *D10B 2501/041* (2013.01)

(58) Field of Classification Search

None

See application file for complete search history.

(56) References Cited

U.S. PATENT DOCUMENTS

| | | | | |
|---|---|---|---|---|
| 8,573,125 | B1 | 11/2013 | Rossow et al. | |
| 10,195,815 | B2 | 2/2019 | Toronjo | |
| 2013/0000005 | A1 | 1/2013 | Hughes et al. | |
| 2017/0182732 | A1* | 6/2017 | Toronjo | A45F 3/12 |
| 2018/0148869 | A1 | 5/2018 | Cross et al. | |
| 2021/0386151 | A1 | 12/2021 | Blakely et al. | |

FOREIGN PATENT DOCUMENTS

| | | | |
|---|---|---|---|
| CN | 108000758 | B | 11/2019 |
| WO | 2022/087682 | A1 | 5/2022 |

OTHER PUBLICATIONS

Communication about intention to grant a European patent Mailed on Dec. 4, 2024 for EP Application No. 23190648, 6 page(s).

Extended European Search Report Mailed on Jan. 5, 2024 for EP Application No. 23190648, 8 page(s).

* cited by examiner

*Primary Examiner* — Arti Singh-Pandey

(74) *Attorney, Agent, or Firm* — Fredrikson & Byron, P.A.

(57) ABSTRACT

Apparatuses are described that provide for auxetic textile structures. An example auxetic textile structure includes an auxetic layer having an inner surface and an outer surface, wherein the auxetic layer comprises a plurality of high performance yarns. The auxetic textile structure further includes a plurality of dispersed elastic portions at least partially coupled to the inner surface of the auxetic layer, wherein the plurality of dispersed elastic portions in combination with the auxetic layer form a plurality of double layer structures distributed amongst a single layer of the auxetic layer. Each of the dispersed elastic portions comprises a plurality of elastic yarns.

20 Claims, 10 Drawing Sheets

AUXETIC TEXTILE STRUCTURES

CROSS-REFERENCE TO RELATED APPLICATIONS

This application claims priority pursuant to 35 U.S.C. 119(a) to Chinese Application No. 202211109310.8, filed Sep. 13, 2022, which application is incorporated herein by reference in its entirety.

TECHNOLOGICAL FIELD

Example embodiments of the present application relate generally to textile materials, and, more particularly, to auxetic textile structures having double layer portions (e.g., having two layers in select portions of the auxetic textile structure) and protective garments incorporating such auxetic textile structures.

BACKGROUND

Textile materials may be manufactured to provide cut-resistance or other high performance properties. In some instances, high performance yarns are used to impart such cut-resistant properties to a textile to create personal protection equipment and protective garments such as gloves, sleeves, shirts, pants, socks, coverings, and the like. Through applied effort, ingenuity, and innovation, many identified deficiencies with existing textile materials have been solved by developing solutions that are included in embodiments of the present disclosure, many examples of which are described in detail herein.

BRIEF SUMMARY

Example embodiments of the present disclosure are directed to an auxetic textile structure. An example auxetic textile structure may include an auxetic layer having an inner surface and an outer surface and a plurality of dispersed elastic portions. The auxetic layer may include a plurality of high performance yarns and each of the dispersed elastic portions may include a plurality of elastic yarns. The plurality of dispersed elastic portions may be at least partially coupled to the inner surface of the auxetic layer and the plurality of dispersed elastic portions in combination with the auxetic layer may form a plurality of double layer structures distributed amongst a single layer of the auxetic layer. In another aspect, a cut-resistant sleeve comprises a plurality of the auxetic textile structures.

In some embodiments, the plurality of high performance yarns may include one or more of ultra-high molecular weight polyethylene (UHMWPE), aramid, metal, glass, basalt, carbon, polybenzoxazole (PBO), polybenzimidazole (PBI), polyether ether ketone (PEEK), polyimide (PI), liquid crystalline polymer (LCP), polyphenylene sulfide (PPS), or a combination thereof. In such embodiments and others, the auxetic layer may further include one or more of a synthetic yarn or a natural yarn, such as polyamide, polyester, cotton, silk, polypropylene, polyethylene, ramie, or a combination thereof.

In some embodiments, the elastic yarns of the dispersed elastic portions may have a lower modulus of elasticity than the high performance yarns of the auxetic layer. In such embodiments and others, the elastic yarns may include one or more of spandex, rubber, thermoplastic elastomer (TPE), thermoplastic vulcanizate (TPV), or a combination thereof.

In some embodiments, the inner surface of the auxetic layer may be visible between the plurality of dispersed elastic portions.

In some embodiments, a void space may be defined between each of the dispersed elastic portions and the auxetic layer in a first state of the auxetic textile structure. In such embodiments and others, the first state may be an unstressed state devoid of external application of stress. In still further embodiments, the void space may be reduced in a second state of the auxetic textile structure. In such embodiments and others, the second state may be a stressed state wherein an external stress is applied to the auxetic textile structure. In still further embodiments, the plurality of dispersed elastic portions may be configured to return the auxetic textile structure to the first state after the external stress is removed.

In some embodiments, the auxetic layer may include a plurality of auxetic segments, the auxetic segments oriented to impart auxetic properties to the auxetic layer. In such embodiments and others, the plurality of auxetic segments may be disposed in a repeating pattern. In further embodiments, the pattern may be an organized array of repeating bow-tie shaped segments. In other embodiments, the pattern may be an organized array of repeating chevron-shaped segments. In still other embodiments, the plurality of auxetic segments may be inconsistently disposed throughout the auxetic layer.

Other example embodiments of the present disclosure are directed to a cut-resistant glove. An example cut-resistant glove may include one or more auxetic textile structures, wherein each of the auxetic textile structures may include an auxetic layer having an inner surface and an outer surface, wherein the auxetic layer comprises a plurality of cut-resistant yarns; and a plurality of dispersed elastic portions at least partially coupled to the inner surface of the auxetic layer, wherein the plurality of dispersed elastic portions in combination with the auxetic layer form a plurality of double layer structures distributed amongst a single layer of the auxetic layer, and wherein each of the dispersed elastic portions comprises a plurality of elastic yarns.

In some embodiments, at least one of the auxetic textile structures may be disposed in a finger portion of the cut-resistant glove. In such embodiments and others, the cut-resistant glove may further include a coating layer, the coating layer comprising one or more of nitrile rubber, natural rubber, polyurethane (PU) rubber, neoprene rubber, polyvinyl chloride (PVC) rubber, wax, latex, or a combination thereof.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Having described certain example embodiments of the present disclosure in general terms above, non-limiting and non-exhaustive embodiments of the subject disclosure will now be described with reference to the accompanying drawings which are not necessarily drawn to scale. The components illustrated in the accompanying drawings may or may not be present in certain embodiments described herein. Some embodiments may include fewer (or more) components than those shown in the drawings.

DETAILED DESCRIPTION

Figure 1A:
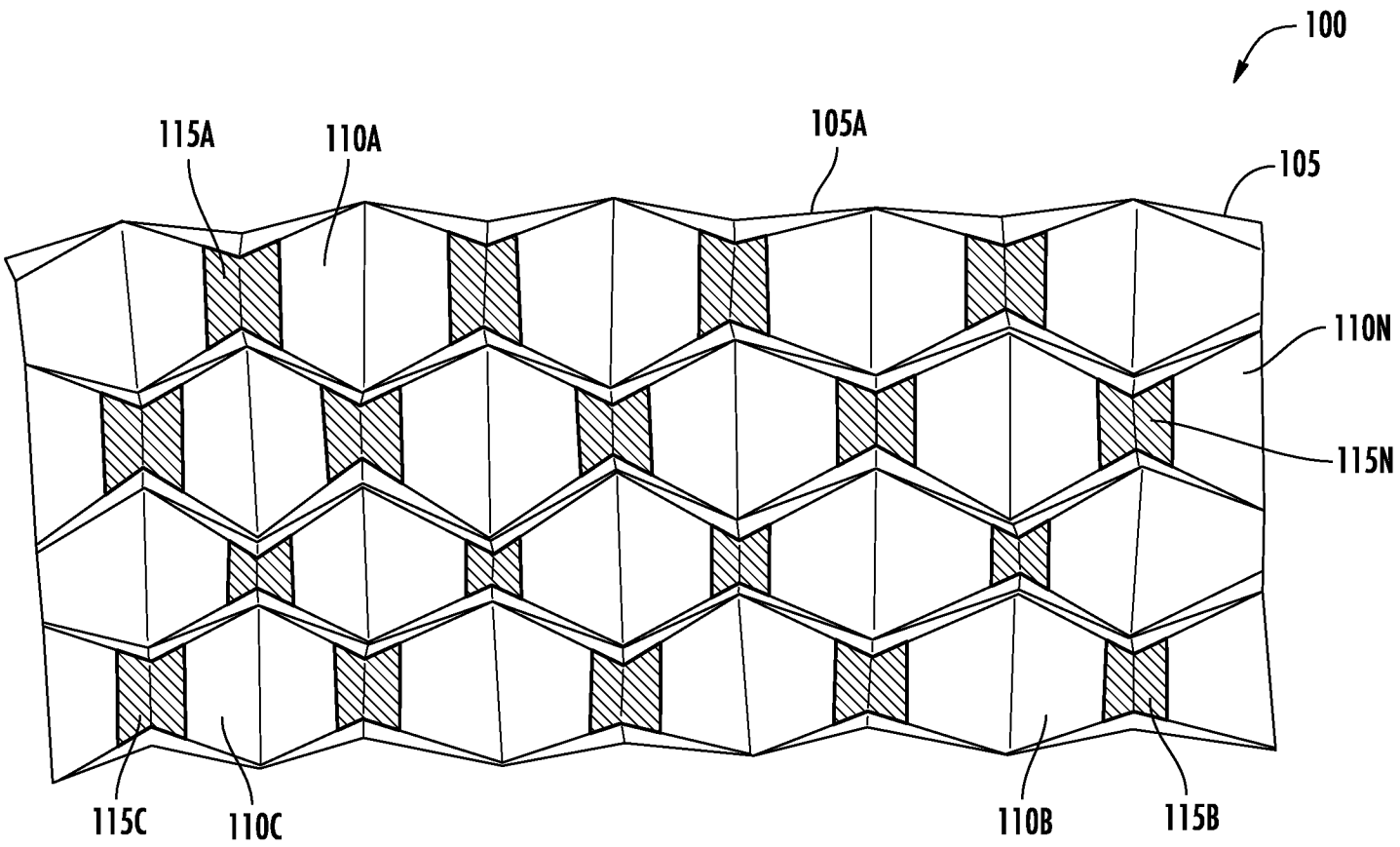
FIG. 1A illustrates a view of an inner surface of an example auxetic textile structure of the present disclosure.

One or more embodiments now will be described more fully hereinafter with reference to the accompanying drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein; rather, these embodiments are provided so that this disclosure will satisfy applicable legal requirements.

Overview

As discussed herein, the present disclosure and the example embodiments are described with reference to an auxetic textile structure, auxetic structure, auxetic material, auxetic layer, or as exhibiting auxetic behavior. In this regard, the term "auxetic" as used herein generally refers to a material or structure possessing a negative Poisson's ratio. The Poisson's ratio of a material is a measure of its expansion or contraction in a direction perpendicular to an applied force. Most materials, when stretched, contract or become thinner in a direction perpendicular to the applied force. These materials possess a positive Poisson's ratio. Auxetic materials or structures, however, expand or become thicker (as opposed to thinner) in a direction perpendicular to the applied force when stretched. This thickening phenomenon is due to the way the auxetic structure deforms in response to lateral stretching.

Figure 1B:
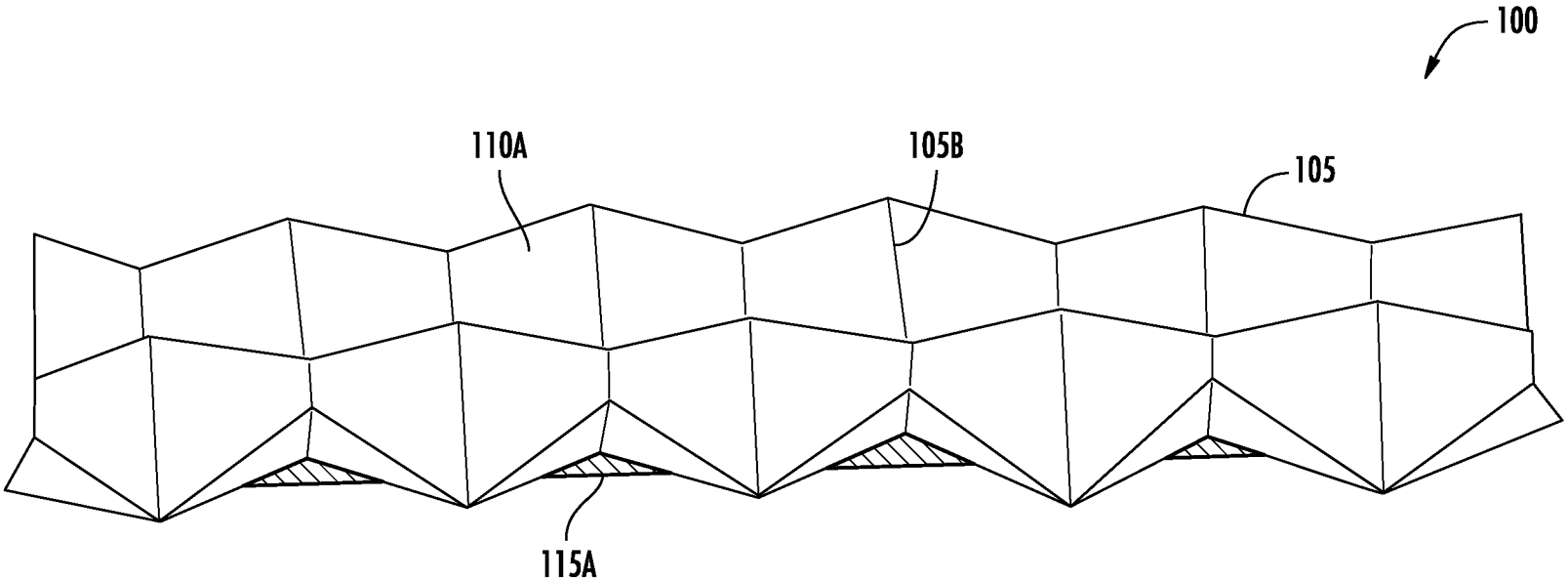
FIG. 1B illustrates a perspective view of an example auxetic textile structure of the present disclosure.
Figure 1C:
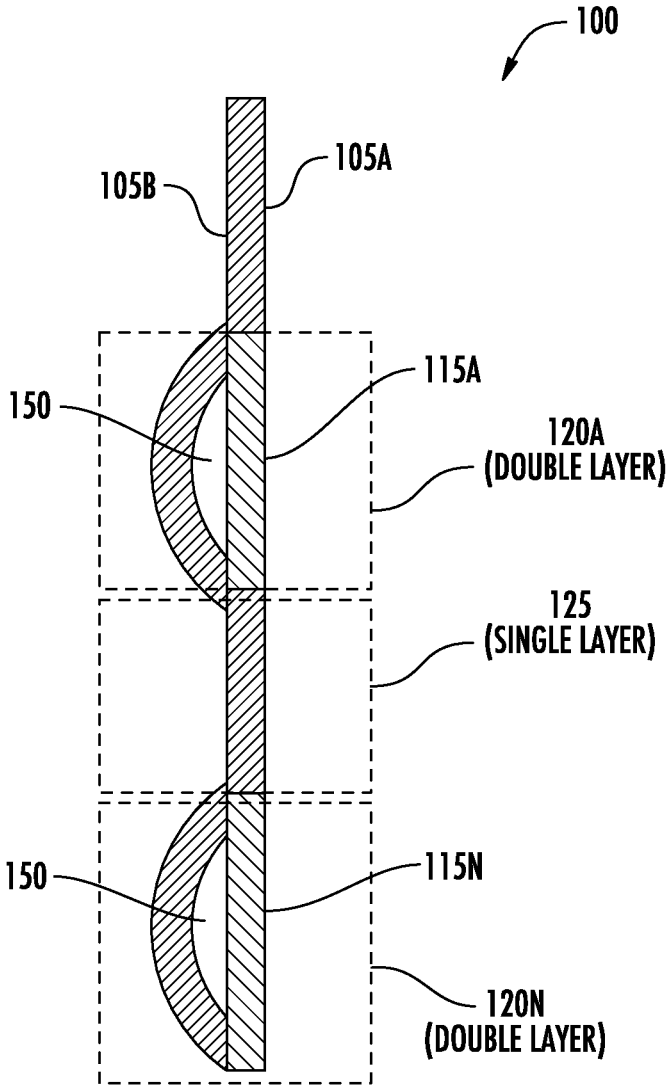
FIG. 1C illustrates a cross-sectional view of an example auxetic textile structure of the present disclosure.
Figure 2A:
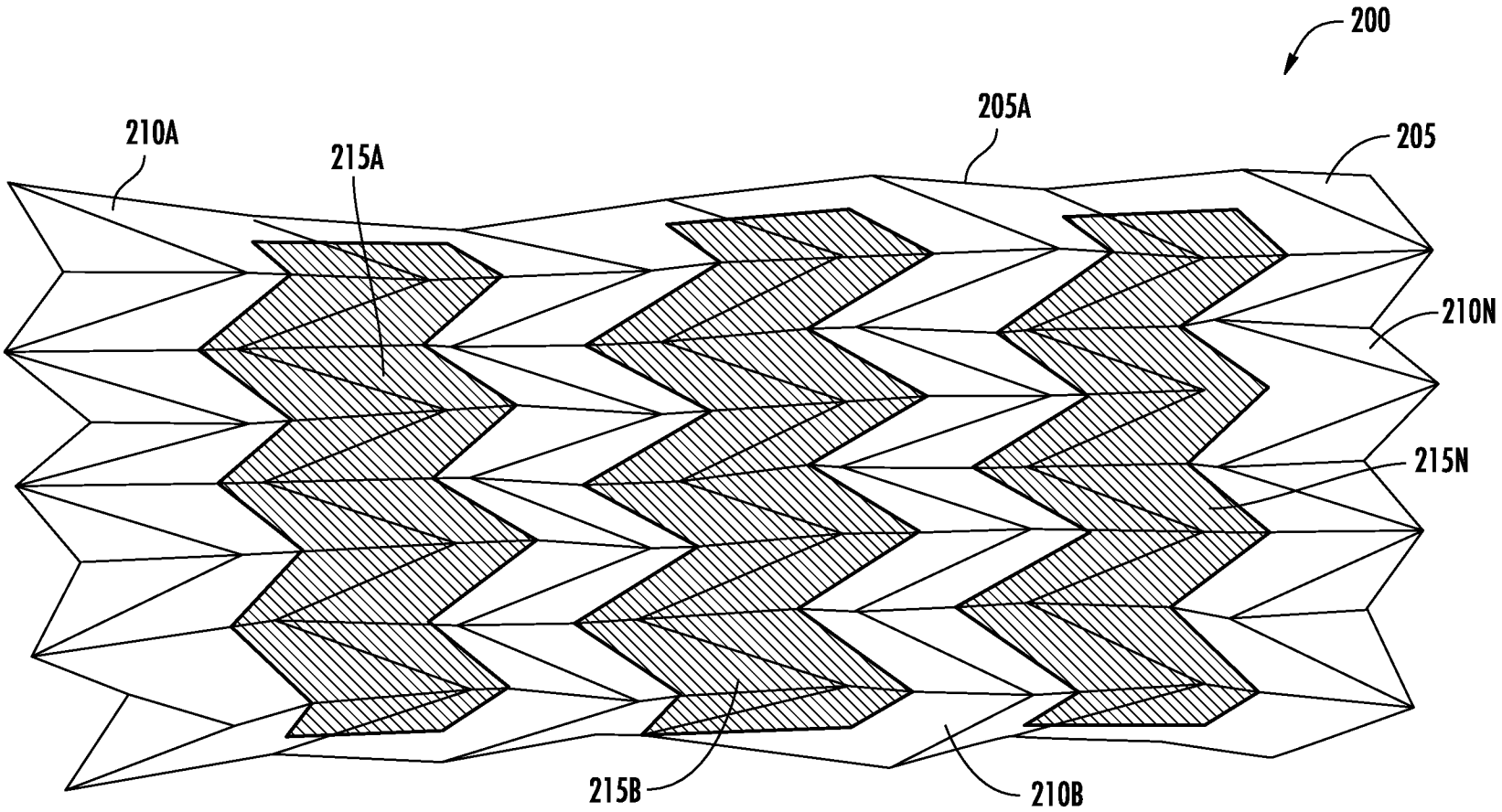
FIG. 2A illustrates a view of an inner surface of another example auxetic textile structure of the present disclosure.
Figure 2B:
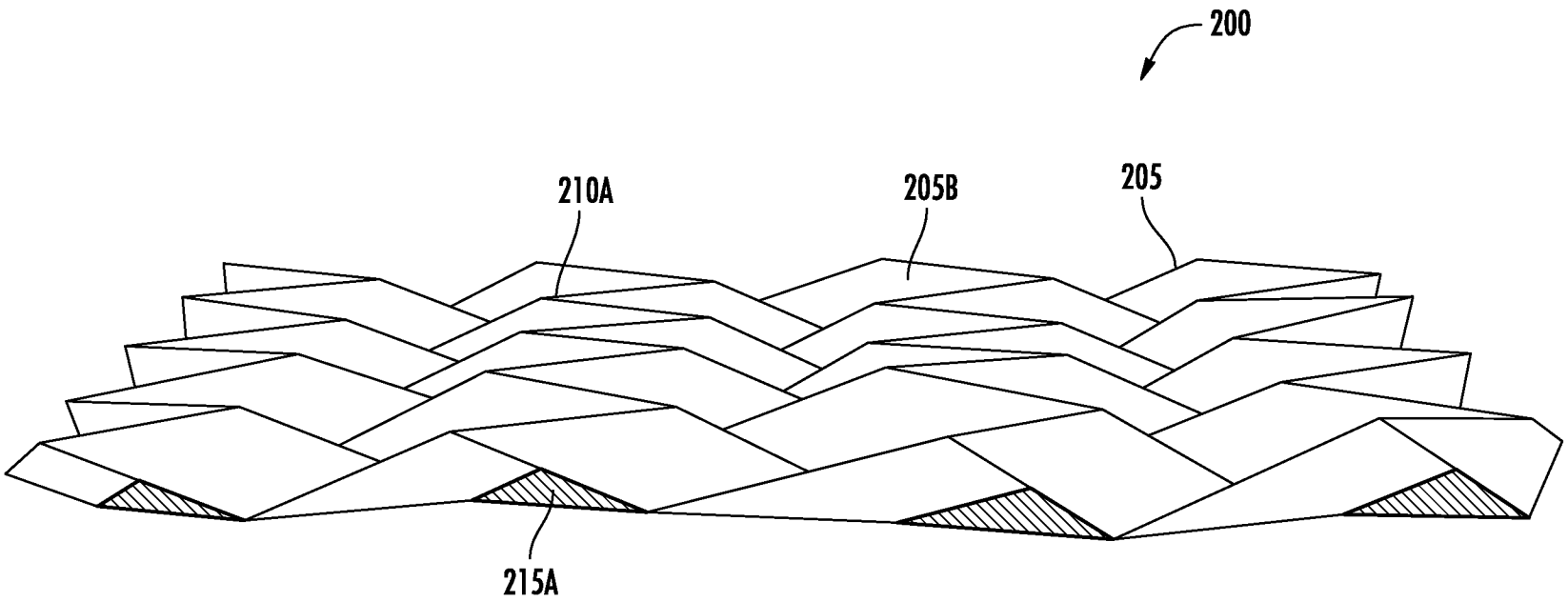
FIG. 2B illustrates a perspective view of another example auxetic textile structure of the present disclosure.
Figure 2C:
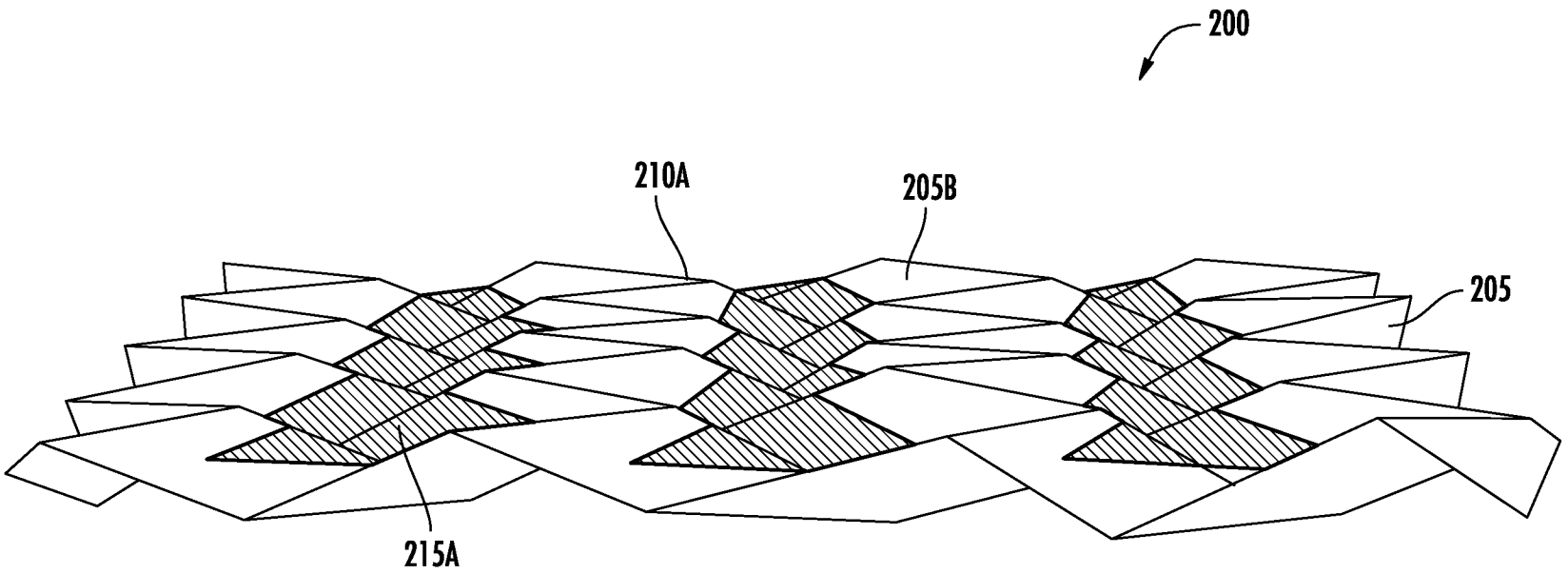
FIG. 2C illustrates another perspective view of an example auxetic textile structure of the present disclosure.
Figure 3A:
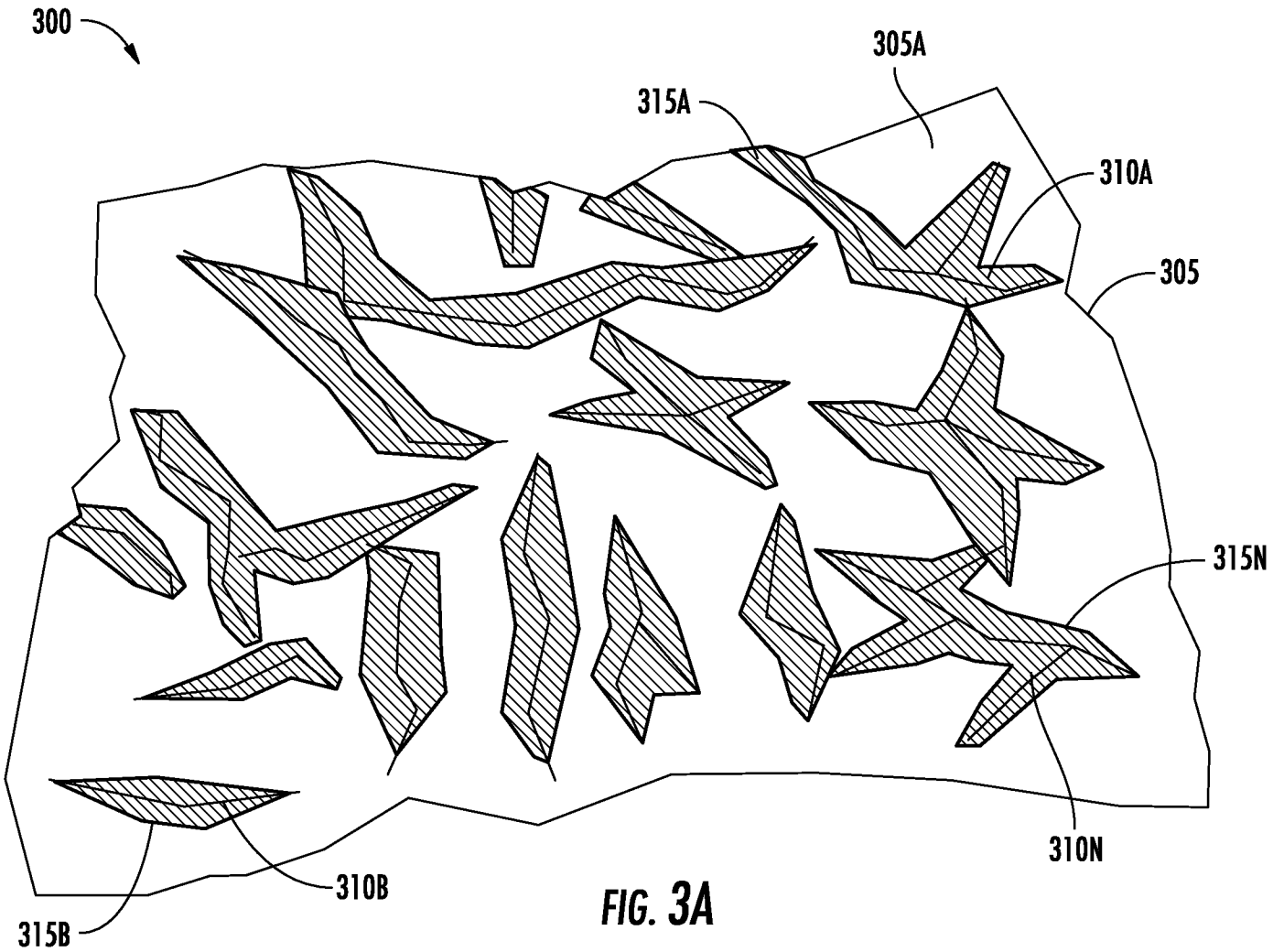
FIG. 3A illustrates a view of an inner surface of another example auxetic textile structure of the present disclosure.
Figure 3B:
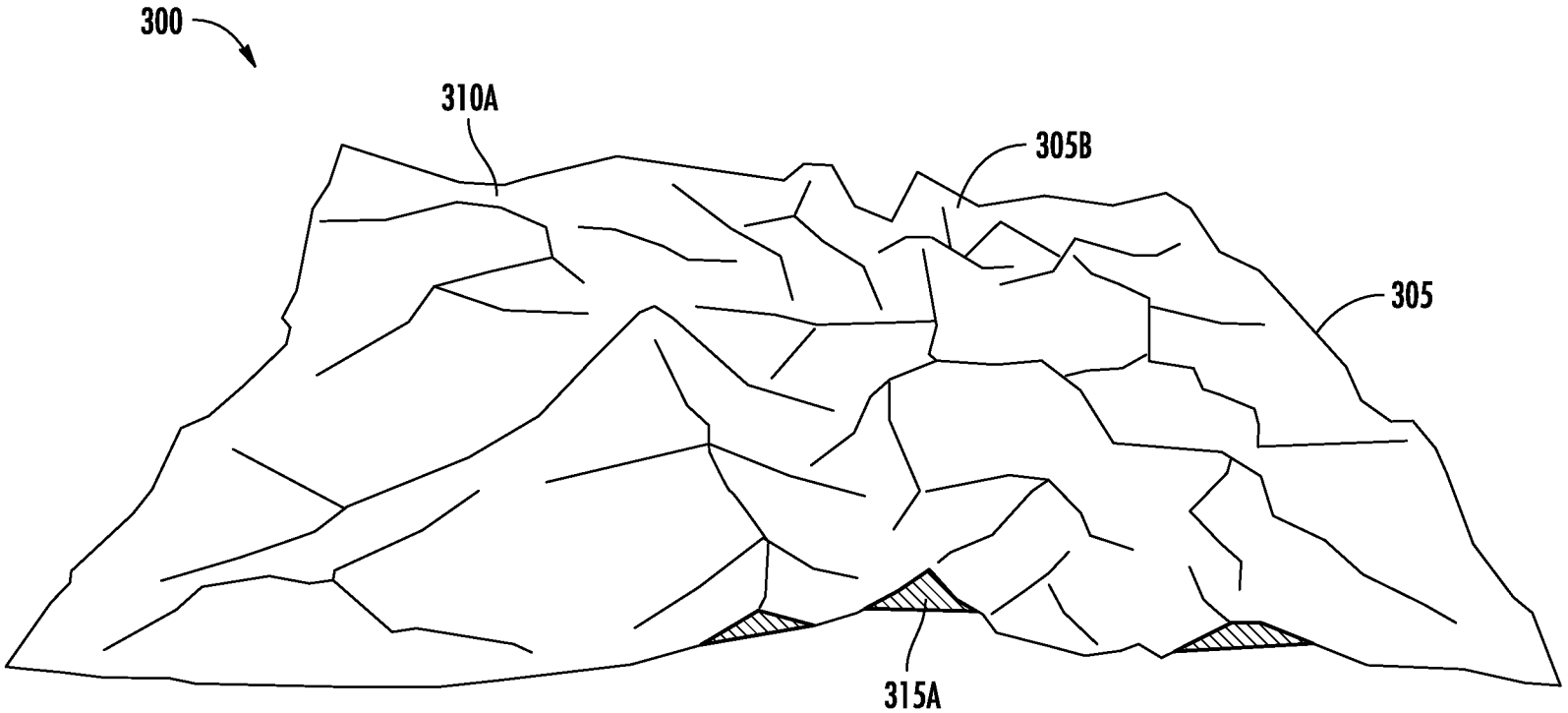
FIG. 3B illustrates a perspective view of another example auxetic textile structure of the present disclosure.

With reference to FIGS. 1A-1C, an example auxetic textile structure 100 of the present disclosure is illustrated. As shown, the auxetic textile structure 100 includes an auxetic layer 105. In some example embodiments, the auxetic layer 105 comprises a plurality of auxetic segments 110A-110N, the auxetic segments 110A-110N oriented to impart auxetic properties to the auxetic layer 105. The depictions in FIG. 1A of "N" auxetic segments are merely for illustration purposes. The auxetic layer 105 may comprise any number of auxetic segments 110A-110N. In other words, the auxetic segments 110A-110N may be shaped, disposed, or arranged in any suitable pattern, arrangement, or orientation known in the art as will impart auxetic behavior such that the auxetic layer 105 expands or becomes thicker perpendicular to an applied force when stretched. By way of example, the auxetic segments 110A-110N may be disposed in a pattern or organized array of repeating bow-tie shaped auxetic segments 110A-110N as depicted in FIGS. 1A-1C or a pattern or organized array of repeating chevron-shaped auxetic segments 210A-210N as depicted in FIG. 2A-2C. While described with reference to a repeating pattern or organized array, the present disclosure contemplates that any combination of shapes, arrangement, or orientation of the auxetic segments 110A-110N may be used based upon the intended use for the auxetic textile structure 100. By way of example, the auxetic segments 110A-110N may be disposed in an inconsistent arrangement, irregular pattern, or disarray as depicted by the exemplary wrinkled auxetic segments 310A-310N in FIGS. 3A-3B.

In some example embodiments, the auxetic layer 105, 205, 305 may comprise a plurality of high performance yarns. Such high performance yarns may be selected to impart one or more of cut-resistance, thermal resistance, flame retardant, or the like. For example, typical cut-resistant materials possessing a positive Poisson's ratio contract or become thinner in a direction perpendicular to an applied force. By way of example, when a user wearing a cut-resistant sleeve bends her elbow, a cut-resistant material possessing a positive Poisson's ratio (i.e., a non-auxetic) becomes tighter at and around the elbow portion of the garment. By instead incorporating an auxetic textile structure 100, 200, 300 including an auxetic layer 105, 205, 305 comprising a plurality of cut-resistant yarns, the garment wearer is provided with improved fit, comfort, flexibility, and dexterity while maintaining cut-resistant properties.

In some embodiments, the high performance (e.g., cut-resistant, thermal resistant, flame retardant, etc.) yarns may be formed of filaments (e.g., continuous fibers), staple yarn (e.g., fibers cut to a shorter length), or a combination thereof. As would be evident to one of ordinary skill in the art in light of the present disclosure, the auxetic layer 105, 205, 305 may be manufactured by any suitable operation or method known in the art. By way of example, the auxetic layer 105, 205, 305 may be formed as a knitted cloth such that the high performance yarns are knitted to obtain the auxetic layer 105, 205, 305 but the auxetic layer 105, 205, 305 may also be formed via non-knitting techniques, such as using weaving or felting techniques. That is, the auxetic layer 105, 205, 305 may be woven, knitted, felted or the like without limitation. In some instances, the auxetic layer 105, 205, 305 may be referred to as an auxetic fabric, an auxetic cloth, or as an auxetic textile. In still further instances when the high performance yarns include cut-resistant yarns, the auxetic layer 105, 205, 305 may be referred to as a cut-resistant fabric, a cut-resistant cloth, or as a cut-resistant textile.

In some example embodiments, the plurality of high performance yarns may include one or more of ultra-high molecular weight polyethylene (UHMWPE), aramid, metal, glass, basalt, carbon, polybenzoxazole (PBO), polybenzimidazole (PBI), polyether ether ketone (PEEK), polyimide (PI), liquid crystalline polymer (LCP), polyphenylene sulfide (PPS), or a combination thereof. By way of example, the plurality of high performance yarns may include a ultra-high molecular weight polyethylene material to impart cut-resistance. Due to the chemical and mechanical properties of these materials, the cut-resistance of the auxetic layer 105, 205, 305 may be improved as compared to an auxetic layer formed without the use of cut-resistant yarns. That is, an auxetic layer 105, 205, 305 comprising cut-resistant yarns, such as UHMWPE yarns, may provide cut protection or tear and abrasion resistance against sharp or jagged objects. While described with reference to a particular implementation including UHMWPE material, the present disclosure contemplates that any combination of the above materials for the plurality of high performance yarns may be used based upon the intended use for the auxetic textile structure 100, 200, 300.

In an example embodiment, the auxetic layer 105, 205, 305 is formed, at least in part, by a plurality of high performance yarns. In this regard, the present disclosure contemplates that the auxetic layer 105, 205, 305 may be a hybrid construction and include yarns, adhesives, and/or materials other than the plurality of high performance yarns. For example, based upon the intended application of the auxetic textile structure 100, 200, 300, in some embodiments, the auxetic layer 105, 205, 305 may further comprise one or more of polyamide, polyester, cotton, silk, polyester, polypropylene, polyethylene, ramie, or a combination thereof. By way of example, the auxetic layer 105, 205, 305 may further comprise a flame or fire retardant material such as aramid, polyimide (PI), polytetrafluoroethylene (PTFE), and/or polyether ether ketone (PEEK) to impart fire retardant properties.

With reference to FIGS. 1-3, the auxetic textile structure 100, 200, 300 further includes a plurality of dispersed elastic portions 115A-115N, 215A-215N, 315A-315N. The depictions in FIGS. 1-3 of "N" elastic portions are merely for illustration purposes. The auxetic textile structure 100, 200, 300 may comprise any number of dispersed elastic portions 115A-115N, 215A-215N, 315A-315N. After application of the stress or force is removed from an exemplary auxetic textile structure 100, the elastic portions 115A-115N, 215A-215N, 315A-315N may function to draw or pull the auxetic layer 105 back into its unstressed state (i.e., rest state). By way of example, by further including a plurality of dispersed elastic portions 115A-115N, 215A-215N, 315A-315N in an exemplary cut-resistant sleeve incorporating a cut-resistant auxetic layer 105, 205, 305, after the garment wearer straightens her elbow (i.e., removes the stress or force), the plurality of dispersed elastic portions 115A-115N, 215A-215N, 315A-315N function to draw or pull the auxetic layer 105, 205, 305 back into its unstressed state (i.e., rest state), thereby providing improved fit, comfort, flexibility, and dexterity while maintaining cut-resistant properties.

In some embodiments, the auxetic layer 105, 205, 305 comprises an inner surface 105A, 205A, 305A and an outer surface 105B, 205B, 305B and the plurality of dispersed elastic portions 115A-115N, 215A-215N, 315A-315N are at least partially coupled to the inner surface 105A, 205A, 305A of the auxetic layer 105, 205, 305. As would be evident to one of ordinary skill in the art in light of the present disclosure, plurality of dispersed elastic portions 115A-115N, 215A-215N, 315A-315N may be at least partially coupled to the inner surface 105A of the auxetic layer 105, 205, 305 by any suitable operation or method known in the art. By way of example, a yarn may extend through the auxetic layer 105, 205, 305, knitting both portions together.

In some example embodiments, the dispersed elastic portions 115A-115N, 215A-215N, 315A-315N may comprise a plurality of elastic yarns. As used herein, an elastic yarn is a yarn imparting sufficient elasticity to draw or pull the auxetic layer 105, 205, 305 back into its unstressed state (i.e., rest state) after removal of a stress/force. In some embodiments, the elastic yarns of the dispersed elastic portions 115A-115N, 215A-215N, 315A-315N may have a lower modulus of elasticity than the high performance yarns of the auxetic layer 105, 205, 305.

In some embodiments, the elastic yarns may be formed of filaments (e.g., continuous fibers), staple yarn (e.g., fibers cut to a shorter length), or a combination thereof. As would be evident to one of ordinary skill in the art in light of the present disclosure, the dispersed elastic portions 115A-115N, 215A-215N, 315A-315N may be manufactured by any suitable operation or method known in the art. By way of example, the dispersed elastic portions 115A-115N, 215A-215N, 315A-315N may be formed as a knitted cloth such that the elastic yarns are knitted to obtain the dispersed elastic portions 115A-115N, 215A-215N, 315A-315N, but the dispersed elastic portions 115A-115N, 215A-215N, 315A-315N may also be formed via non-knitting techniques, such as using weaving or felting techniques. That is, the dispersed elastic portions 115A-115N, 215A-215N, 315A-315N may be woven, knitted, felted or the like without limitation.

In some example embodiments, the plurality of elastic yarns may include one or more of spandex, rubber, thermoplastic elastomer (TPE), thermoplastic vulcanizate (TPV), or a combination thereof. By way of example, the plurality of elastic yarns may include a spandex material. Due to the elastic performance of these materials, the fit and comfort of a protective garment or other article may be improved as compared to a protective garment formed without the use of a cut-resistant auxetic layer 105, 205, 305 in conjunction with dispersed elastic portions 115A-115N, 215A-215N, 315A-315N. While described with reference to a particular implementation including spandex material, the present disclosure contemplates that any combination of the above materials for the plurality of elastic yarns may be used based upon the intended use for the auxetic textile structure 100, 200, 300.

As depicted in FIG. 1C, in some example embodiments, the plurality of dispersed elastic portions 115A-115N, in combination with the auxetic layer 105, form a plurality of double layer structures 120A-120N distributed amongst a single layer 125 of the auxetic layer 105. In this regard, regions of the auxetic textile structure 100, 200, 300 may be single-layered (i.e., including only the auxetic layer 105, 205, 305) and other regions of the auxetic textile structure 100, 200, 300 may be double-layered (i.e., including the auxetic layer 105, 205, 305 and a dispersed elastic portion 115A, 215A, 315A). That is, a plurality of distinct (e.g., spaced apart) regions of the auxetic textile structure 100, 200, 300 may be double-layered, while the remaining regions of the auxetic textile structure 100, 200, 300 may be single-layered (i.e., the plurality of dispersed elastic portions 115A-115N in combination with the auxetic layer 105 form a plurality of double layer structures 120A-120N distributed amongst a single layer 125 of the auxetic layer 105 as depicted in FIG. 1C). In some example embodiments, the auxetic layer 105, 205, 305 forms a first layer and the plurality of dispersed elastic portions 115A-115N, 215A-215N, 315A-315N form a distributed second layer of an auxetic textile structure 100, 200, 300 of the present disclosure. Additionally or alternatively, in some embodiments, the inner surface 105A, 205A, 305A of the auxetic layer 105, 205, 305 is visible between the plurality of dispersed elastic portions 115A-115N, 215A-215N, 315A-315N.

With reference to FIG. 1C, in some embodiments, a void space 150 is defined between each of the dispersed elastic portions 115A-115N and the auxetic layer 105 in a first state of the auxetic textile structure 100. In still further embodiments, the first state of the auxetic textile structure 100 is an unstressed state, devoid of external application of stress. By way of example, in an instance wherein an auxetic textile structure 100 is incorporated into an elbow portion of a cut-resistant sleeve, the first state corresponds to an unstressed state such as the elbow of the wearer being in a straight configuration. In some embodiments, the void space 150 is reduced in a second state of the auxetic textile structure 100, wherein the second state comprises a stressed state wherein an external stress is applied to the auxetic textile structure 100. By way of example, in an instance wherein an auxetic textile structure 100 is incorporated into an elbow portion of a cut-resistant sleeve, the second state corresponds to a stressed state such as the elbow of the wearer being in a bent configuration. In still further embodiments, the plurality of dispersed elastic portions 115A-115N may be configured to return the auxetic textile structure 100 to the first state after the external stress is removed (i.e., the wearer returns her elbow to a straight configuration).

In some example embodiments, the auxetic textile structure 100, 200, 300 may be formed into any suitable shape or size based upon the intended use for the auxetic textile structure 100, 200, 300. By way of example, the auxetic textile structure 100, 200, 300 may be configured to have a tubular shape (e.g., tubular portion 430) such that it may form a cut-resistant sleeve 400 as depicted in FIG. 4 or as one or more tubular or finger portion(s) 530 of a cut-resistant glove 500 as depicted in FIG. 5.

Figure 4:
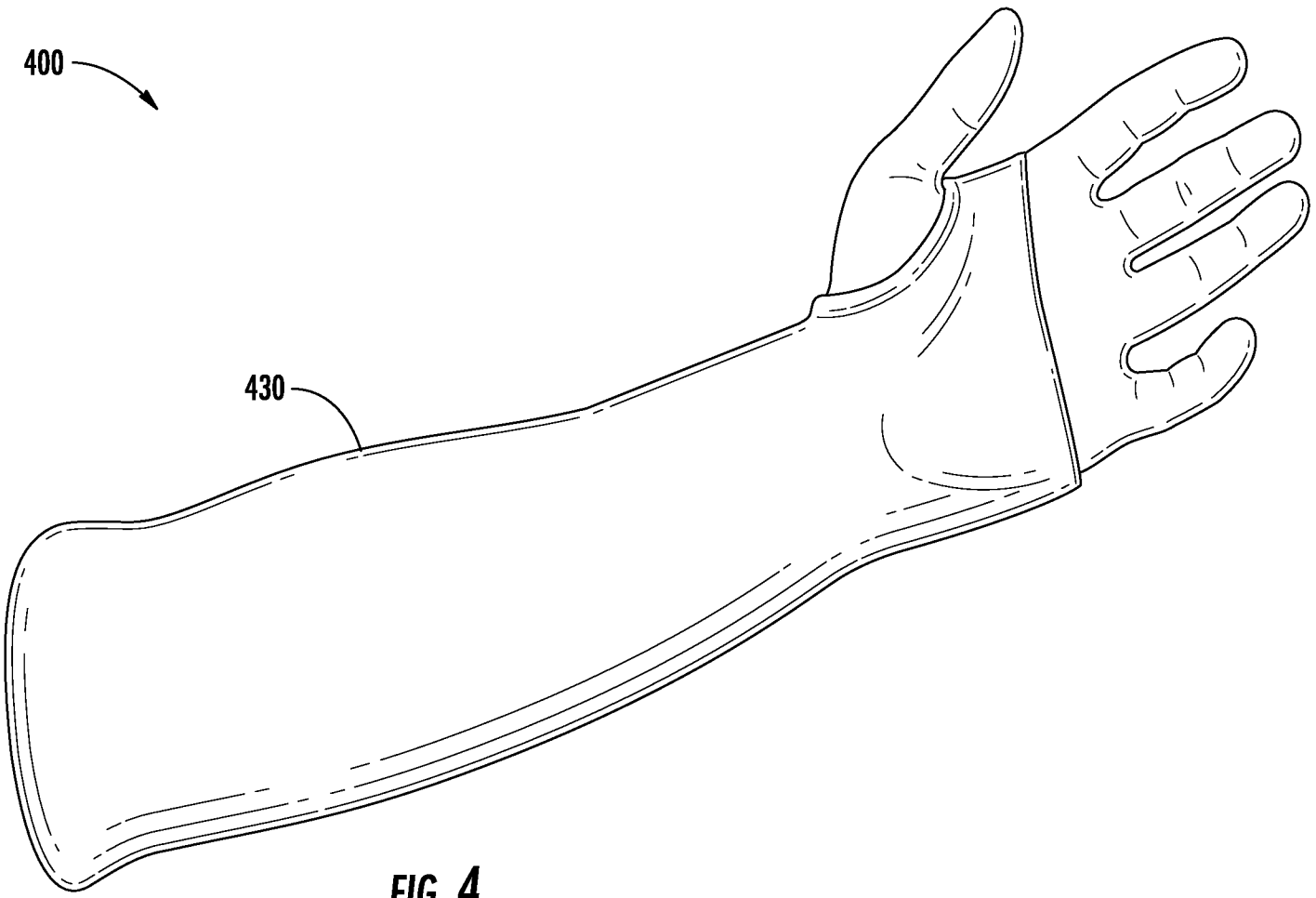
FIG. 4 illustrates an example sleeve for implementing example auxetic textile structures of the present disclosure.

With reference to FIG. 4, an exemplary cut-resistant sleeve 400 for implementing example auxetic textile structures (e.g., auxetic textile structures 100, 200, 300 in FIGS. 1-3) of the present disclosure is illustrated. As shown, the cut-resistant sleeve 400 may be manufactured or otherwise formed (e.g., woven, knitted, or the like) of an auxetic layer comprising a plurality of cut-resistant yarns and a plurality of dispersed elastic portions at least partially coupled to the inner surface (e.g., the surface facing an elbow of a user wearing the cut-resistant sleeve) of the auxetic layer, each of the dispersed elastic portions comprising a plurality of elastic yarns.

Figure 5:
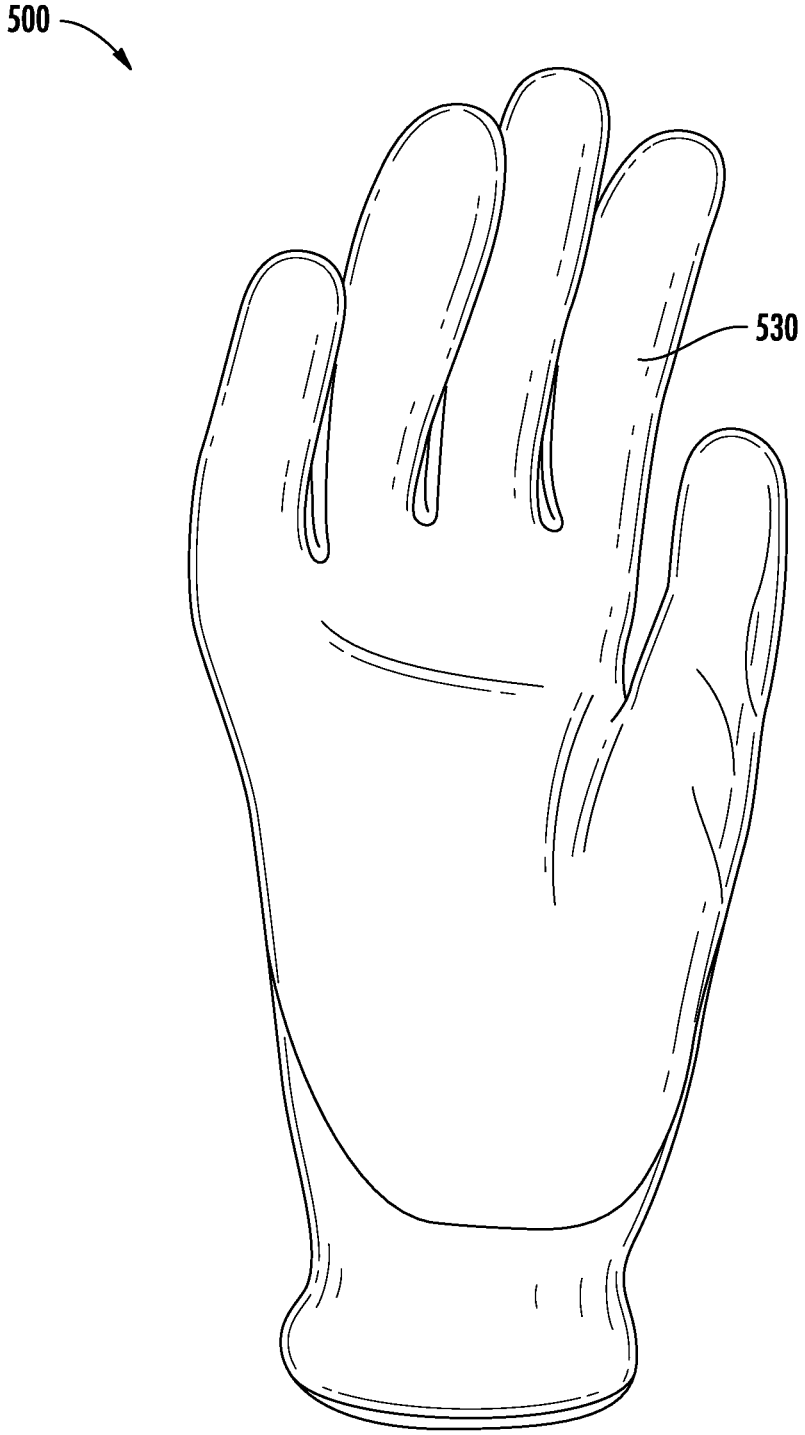
FIG. 5 illustrates an example glove for implementing example auxetic textile structures of the present disclosure.

With reference to FIG. 5, an exemplary cut-resistant glove 500 for implementing example auxetic textile structures (e.g., auxetic textile structures 100, 200, 300 in FIGS. 1-3) of the present disclosure is illustrated. As shown, the cut-resistant glove 500 including one or more tubular or finger portion(s) 530 may be manufactured or otherwise formed (e.g., woven, knitted, or the like) of an auxetic layer comprising a plurality of cut-resistant yarns and a plurality of dispersed elastic portions at least partially coupled to the inner surface (e.g., the surface facing a hand of a user wearing the cut-resistant glove) of the auxetic layer, each of the dispersed elastic portions comprising a plurality of elastic yarns.

While illustrated and described with reference to auxetic textile structures 100, 200, 300 used in forming a cut-resistant sleeve or a cut-resistant glove 500, the present disclosure contemplates that the auxetic textile structures 100, 200, 300 described herein may equally be used to form any personal protection equipment or other protective garment (e.g., gloves, sleeves, shirts, jackets, pants, socks, aprons, overalls, coverings, or the like) without limitation. In some example embodiments, the entirety of the protective garment is formed using auxetic textile structures of the present disclosure. In still other example embodiments, one or more auxetic textile structures 100, 200, 300 of the present disclosure are placed, formed, or incorporated into strategic places in a protective garment, such as in the finger portion(s), elbow portion(s), knee portion(s), etc.

With continued reference to FIG. 5, the auxetic layer of the auxetic textile structure 100, 200, 300 according to the present disclosure may serve as the exterior layer of the cut-resistant glove 500 (i.e., a garment) such that the auxetic layer comprising cut resistant yarns will be contacted by the sharp or jagged object first in order to provide cut protection or tear and abrasion resistance. Additionally or alternatively, the cut-resistant glove 500 may further include a coated material (e.g., nitrile rubber, natural rubber, polyurethane (PU), rubber, neoprene rubber, polyvinyl chloride (PVC) rubber, wax, latex, or the like) applied to the auxetic textile structure (e.g., the outer surface of the auxetic layer or the exterior of the cut-resistant glove) based upon the intended use of the cut-resistant glove 500. These coated materials may be applied via dip coating, micro foaming, sandy finish, smooth finish, and/or any other application process known in the art. The present disclosure contemplates that any number of coating layers or coated materials may be applied or incorporated to configure the auxetic textile structure for a particular use.

As used herein, terms such as "inner", "outer", "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The term "comprising" means including but not limited to, and should be interpreted in the manner it is typically used in the patent context. The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment). If the specification describes something as "exemplary" or an "example," it should be understood that refers to a non-exclusive example.

The terms "about" or approximately" or the like, when used with a number, may mean that specific number, or alternatively, a range in proximity to the specific number, as understood by persons of skill in the art field. If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Accordingly, use of any such terms should not be taken to limit the spirit and scope of embodiments of the present disclosure.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An auxetic textile structure comprising:

an auxetic layer having an inner surface and an outer surface, wherein the auxetic layer comprises a plurality of high performance yarns; and a plurality of dispersed elastic portions at least partially coupled to the inner surface of the auxetic layer, wherein the plurality of dispersed elastic portions in combination with the auxetic layer form a plurality of double layer structures distributed amongst a single layer of the auxetic layer, and wherein each of the dispersed elastic portions comprises a plurality of elastic yarns.

2. The auxetic textile structure of claim 1, wherein the plurality of high performance yarns comprises one or more of ultra-high molecular weight polyethylene (UHMWPE), aramid, metal, glass, basalt, carbon, polybenzoxazole (PBO), polybenzimidazole (PBI), polyether ether ketone (PEEK), polyimide (PI), liquid crystalline polymer (LCP), polyphenylene sulfide (PPS), or a combination thereof.

3. The auxetic textile structure of claim 1, wherein the auxetic layer further comprises one or more of a synthetic yarn or a natural yarn.

4. The auxetic textile structure of claim 1, wherein the elastic yarns of the dispersed elastic portions have a lower modulus of elasticity than the high performance yarns of the auxetic layer.

5. The auxetic textile structure of claim 1, wherein the elastic yarns comprise one or more of spandex, rubber, thermoplastic elastomer (TPE), thermoplastic vulcanizate (TPV), or a combination thereof.

6. The auxetic textile structure of claim 1, wherein the inner surface of the auxetic layer is visible between the plurality of dispersed elastic portions.

7. The auxetic textile structure of claim 1, wherein a void space is defined between each of the dispersed elastic portions and the auxetic layer in a first state of the auxetic textile structure.

8. The auxetic textile structure of claim 7, wherein the first state comprises an unstressed state devoid of external application of stress.

9. The auxetic textile structure of claim 7, wherein the void space is reduced in a second state of the auxetic textile structure.

10. The auxetic textile structure of claim 9, wherein the second state comprises a stressed state wherein an external stress is applied to the auxetic textile structure.

11. The auxetic textile structure of claim 10, wherein the plurality of dispersed elastic portions are configured to return the auxetic textile structure to the first state after the external stress is removed.

12. The auxetic textile structure of claim 1, wherein the auxetic layer comprises a plurality of auxetic segments, the auxetic segments oriented to impart auxetic properties to the auxetic layer.

13. The auxetic textile structure of claim 12, wherein the plurality of auxetic segments are disposed in a repeating pattern.

14. The auxetic textile structure of claim 12, wherein the pattern is an organized array of repeating bow-tie shaped segments.

15. The auxetic textile structure of claim 13, wherein the pattern is an organized array of repeating chevron-shaped segments.

16. The auxetic textile structure of claim 12, wherein the plurality of auxetic segments are inconsistently disposed throughout the auxetic layer.

17. A cut-resistant sleeve comprising a plurality of auxetic textile structures according to claim 1.

18. A cut-resistant glove comprising:

one or more auxetic textile structures, wherein each of the auxetic textile structures comprise:

an auxetic layer having an inner surface and an outer surface, wherein the auxetic layer comprises a plurality of cut-resistant yarns; and a plurality of dispersed elastic portions at least partially coupled to the inner surface of the auxetic layer, wherein the plurality of dispersed elastic portions in combination with the auxetic layer form a plurality of double layer structures distributed amongst a single layer of the auxetic layer, and wherein each of the dispersed elastic portions comprises a plurality of elastic yarns.

19. The cut-resistant glove or sleeve of claim 18, wherein at least one of the auxetic textile structures is disposed in a finger portion of the cut-resistant glove.

20. The cut-resistant glove of claim 18, wherein the cut-resistant glove further comprises a coating layer, the coating layer comprising one or more of nitrile rubber, natural rubber, polyurethane (PU) rubber, neoprene rubber, polyvinyl chloride (PVC) rubber, wax, latex, or a combination thereof.

* * * * *